United States Patent [19]

Palmer

[11] Patent Number: 4,531,455

[45] Date of Patent: Jul. 30, 1985

[54] VENTILATORS

[75] Inventor: George J. Palmer, Ilford, England

[73] Assignee: Turbo Ventana Limited, London, England

[21] Appl. No.: 569,243

[22] Filed: Jan. 9, 1984

[30] Foreign Application Priority Data

Jan. 26, 1983 [GB] United Kingdom ..... 8302108

[51] Int. Cl.[3] ..... E06B 7/02

[52] U.S. Cl. ..... 98/96; 98/20; 98/42.01

[58] Field of Search ..... 98/2.14, 20, 42 R, 70, 98/78, 96, 118

[56] References Cited

FOREIGN PATENT DOCUMENTS 777442 2/1935 France ..... 98/78

568286 3/1945 United Kingdom ..... 98/20

*Primary Examiner*—Harold Joyce

*Attorney, Agent, or Firm*—David B. Harrison

[57] ABSTRACT

A ventilator or extractor unit is disclosed for mounting at an aperture in a wall, duct, window pane or the like. The unit includes a first approximately annular part which in use is secured to the window pane or the like with a central aperture in said annular part in register with the aperture in the window pane or the like. A further generally annular part is spaced from the first-mentioned annular part on the side of the first-mentioned part remote from the window pane or the like, the further annular part being supported from the first-mentioned part by four pillars at the peripheries of the annular parts. A second part in the form of a circular lens, is supported centrally, approximately midway between the annular parts. Due to the shape of the lens, air currents passing on the outside of the window pane, parallel therewith and passing between the annular parts and around the lens will, by the Venturi effect, produce a depression in the region of the apertures in the first-mentioned annular part and the window pane which will draw fumes etc. from the space on the window out through said apertures.

8 Claims, 6 Drawing Figures

VENTILATORS

FIELD OF THE INVENTION

This invention relates to ventilators and in particular to a ventilator or extractor unit intended to be secured to a wall duct, window pane or other panel or sheet-like supporting member.

BACKGROUND OF THE INVENTION

Ventilator or extractor units of the above noted character are already known, and generally fall into two categories, in a first one of which a fan driven by an electric motor is used to draw air, fumes etc; through the units, and in the second of which categories a freely rotatable, non-driven fan is, in use, caused to rotate by the passage of air in either direction through the unit in response to an air-pressure difference between the opposite sides of the pane, panel or the like in which the unit is mounted. The third category is the louvred or squared sectional trim designed to neaten a ventilation opening. Units of the first category are fairly effective, but have the disadvantages of being a relatively heavy, expensive to manufacture, somewhat difficult to install and of course, of consuming electrical energy. Units of the second category, on the other hand, whilst being free of most of the above noted disadvantages have, in general, the serious disadvantage that they are relatively ineffective, the freely rotatable fan serving mainly to distribute the air passing in either direction through the unit somewhat so as to reduce the intensity of the draughts which would result if the unit simply provided a completely open aperture unobstructed by a fan. The third category simply provides a completely open aperture allowing unrestricted air movement in either direction. These disadvantages often result in the ventilator being immobilised or removed.

SUMMARY OF THE INVENTION

It is an object of the present invention to provide a permanent or closable ventilator or extractor unit which does not require an associated electrical or other power unit and which, at the same time, is relatively effective and draught-free, without any of the previously described disadvantages.

According to the present invention there is provided a ventilator or extractor unit adapted for securing to a wall duct, window pane or other sheet-like supporting member at an aperture therein, the unit being formed to provide, when so secured, an inlet and outlet for an air stream passing, on one side of the wall, duct, pane or other supporting member with a component substantially along a surface of said wall, duct, pane or other supporting member in at least one direction, and a passage for such air stream between said inlet and outlet, the unit having an aperture communicating transversely with said passage, for communication, via the corresponding aperture in the wall, duct, pane or other supporting member, with the other side of the latter, the unit being so formed that an air stream passing through the said passage from said inlet to said outlet will, by the Venturi effect, produce a pressure reduction in said passage so as to tend to draw air, fumes or other gaseous matter into said passage via said aperture from said other side of said wall, duct, pane or other supporting member.

The principle underlying the present invention is that the extraction of stale air, fumes, condensation etc, from the interior of a building to which the unit is fitted can be accomplished by utilising the energy of wind currents on the outside of the building.

In a preferred embodiment of the invention, the ventilator or extractor unit may include a first member adapted be secured to said wall, duct, pane or other supporting member, and providing said aperture, and a second member spaced from said first member opposite to said aperture and being convexly curved in the direction towards said aperture, said second member being supported from said first member through the intermediary of one or more pillars of small diametral extent as compared with said second member so that any diametrally opposed regions of the space defined between said first and second member may serve as said inlet and outlet to said passage, defined between said first and second members.

BRIEF DESCRIPTION OF THE DRAWINGS

An embodiment of the invention is described below by way of example with reference to the accompanying drawings.

In the drawings.

DESCRIPTION OF PREFERRED EMBODIMENT

Figure 1:
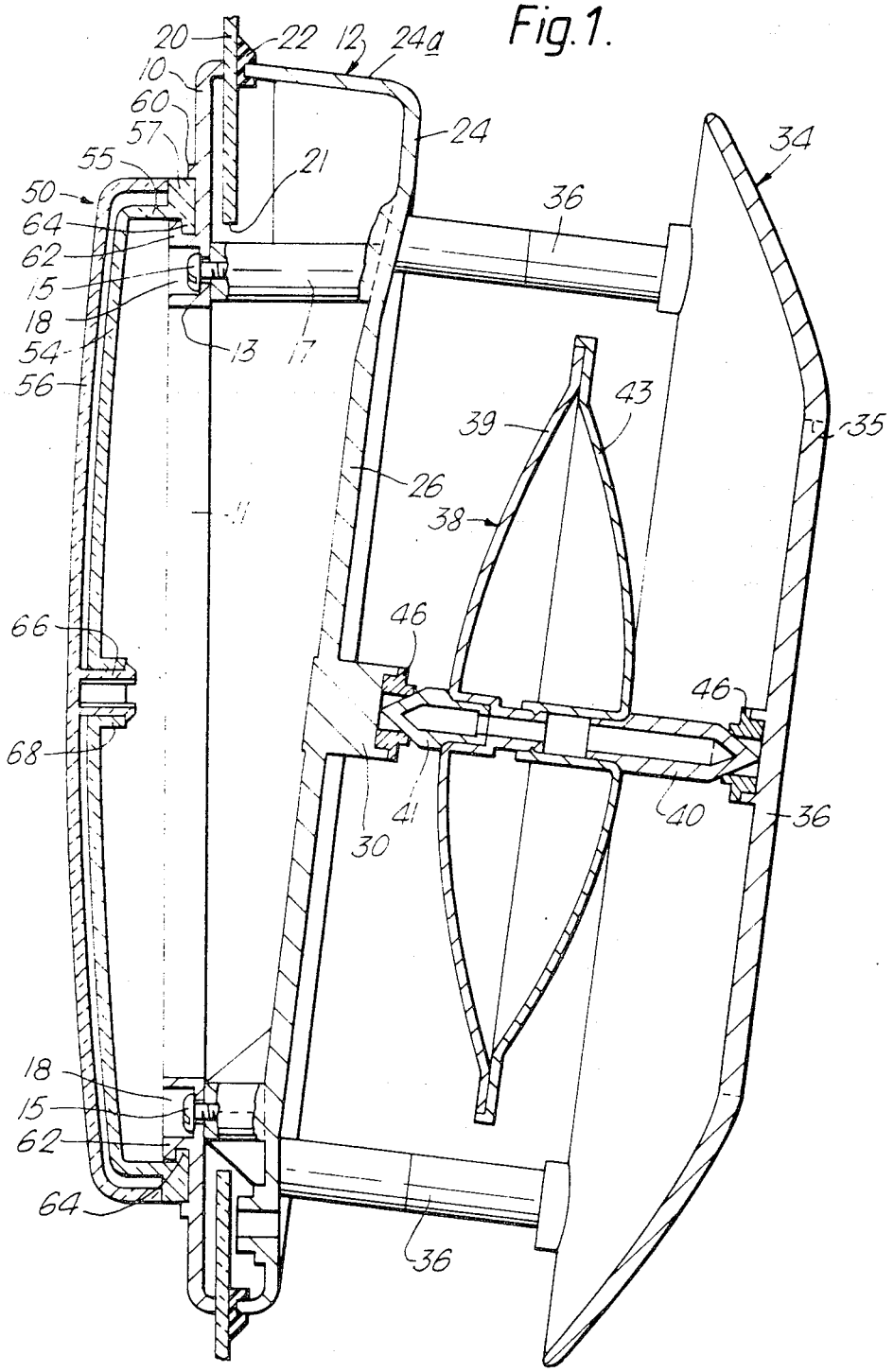
FIG. 1 is a view in vertical section of a ventilator unit embodying the invention mounted in a window pane.
Figure 2:
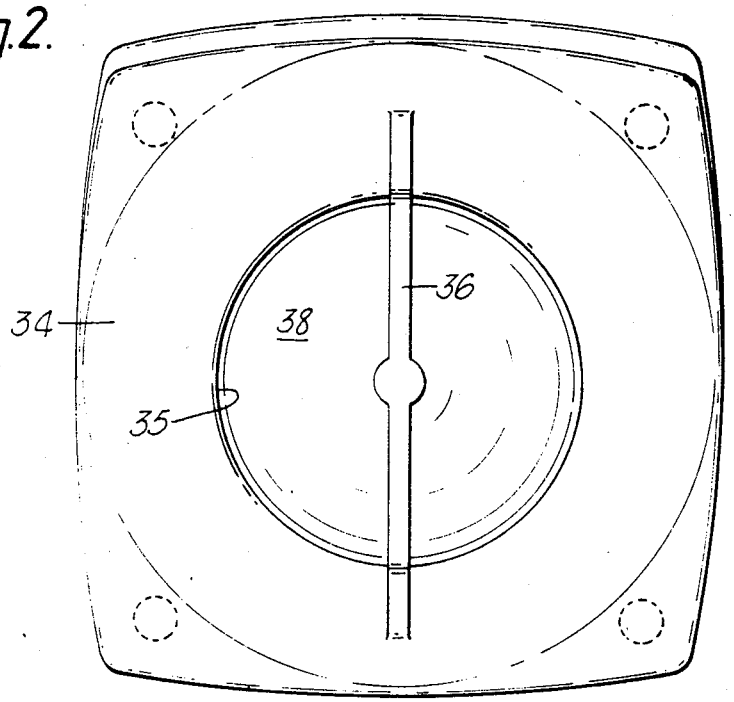
FIG. 2 is an elevation view of the unit of FIG. 1 from the outside of the window pane.

Referring to the drawings, a ventilator extractor unit comprises a first member, adapted to be secured to a window pane 20 and comprising a generally annular mounting plate 10, which engages the inner surface of the window pane 20, around an aperture 21 in the pane, and an inner cover plate 12, which engages the outer surface of the window pane. The mounting plate 10 has a generally planar peripheral portion and a circular central aperture 11. A seal 22, disposed the peripheral edge or rim of plate 12 engages the pane 20 and is clamped between the plate 12 and pane 20.

Lugs 13 projecting inwardly from the periphery of collar 18 have apertures through which extend fixing screws 15 screwed into metal inserts bonded within pillars 17 formed integrally with plate 12. The pane 20 and seal 22 are thus clamped between plate 10 and plate 12. Compression of the seal 22 is limited by engagement of lugs 13 with pillars 17.

Thus the plate 12 is located in the plate 10 by the screws 15, and the plates 10 and 12 and both are located relative to the pane by the frictional engagement of the seal 22 with the pane 20.

Figure 3:
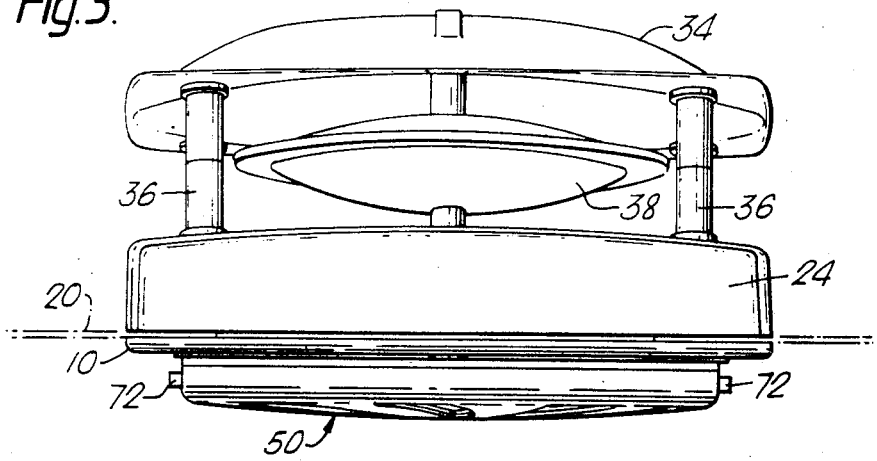
FIG. 3 is a plan view from above of the unit.
Figure 5:
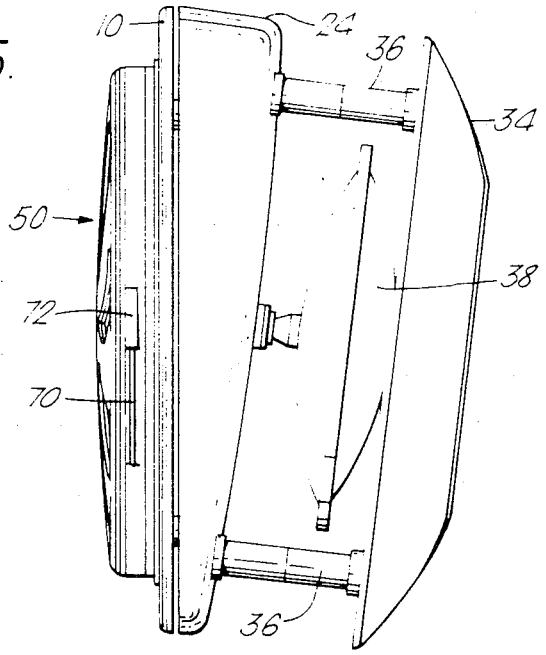
FIG. 5 is a side view of the unit.

The inner cover plate 12 comprises an approximately planar major portion 24 from the pheriphery of which extends a skirt **24*a*, (FIGS. 3 and 5) the free edge of which engages the outer surface of the window pane 20, around the opening 21**.

Figure 6:
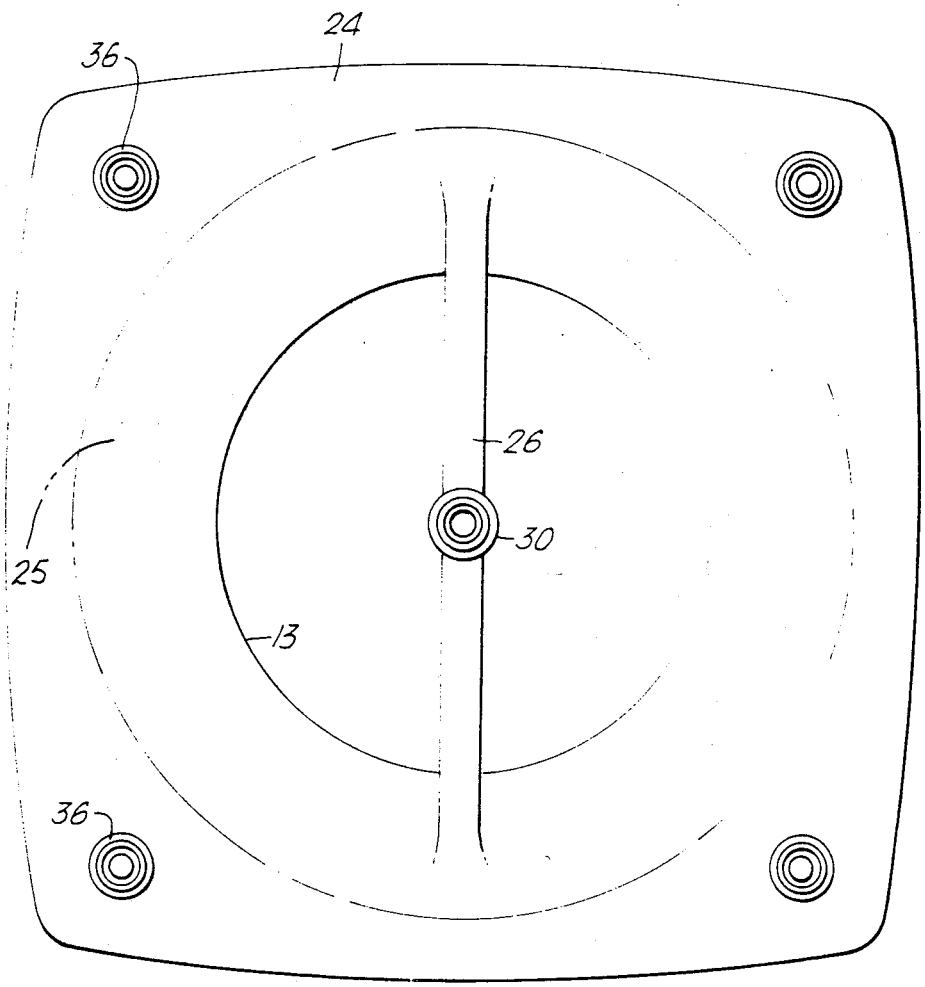
FIG. 6 is an elevation view, from the outside of the window pane, of an inner cover plate forming part of the unit.

The depth of the skirt **24*a* is greater at the upper end of the unit than at the lower end so that the median plane of the portion 24 is slightly inclined with respect to the plane of the pane 20, sloping upwardly away from the pane 20. The central portion 24 of the plate 12 has, as best shown in FIG. 6, a circular central aperture 13, spanned by an integral, vertical, diametral strut 26**.

An outer cover member 34, in the form of a dished plate is supported from the plate 12, and spaced therefrom and from pane 20, by four pillars 36. The cover member 34, the member 12 and the plate 10 all have a pheripheral shape in the approximate form of a square with barrelled sides, although of course, any other suitable shape may be utilised. The pheripheral edge of the outer cover plate 34 lies in a plane herein referred to as the median plane of plate 34, which is substantially parallel with the median plane of the major part 24 of the plate 12, and the pillars 36 are at right angles to these planes and are disposed adjacent respective corners of the members 34 and 12. The plate 34 is provided internally with a central circular aperture 35 spanned by a vertical, diametrically extending spar 36. The plate 34 is disposed with its concave side facing the plate 12.

Located between the plates 34 and 12 is a member 38 having the general form of a bi-convex lens of a diameter somewhat greater than the circular apertures 13 and 35 in the plates 12 and 34, the lens having ellipsoidal surfaces. The member 38 is supported with its axis of rotational symmetry perpendicular to said median planes, and passing through the centres of the struts 24 and 36, by means of central spindles 40, 41 projecting axially on different sides of the lens 38 and with respect to the lens, the spindles 40, 41 being supported at their outer ends in respective bearings provided respectively on the spars 36 and 26. The median plane of the member 38, which is a plane normal to the axis of member 38 in which the peripheral edge of the member 38 lies, extends parallel with the median plane of the plate 34 and the plate 12.

The member 38 comprises two dished circular shells, or domes, secured together with their concave surfaces facing towards one another. The shell or dome 39 providing the surface of member 38 which faces towards plate 12 may be shallower and less pronouncedly curved than the other shell 43 and is herein referred to, as the shallow dome, whereas the other shell 43 is herein referred to as the deep dome.

Considering the bearing arrangement for the spindles 40, 41 in greater detail, the spindles 40, 41 are conically pointed at their outer ends, the conical points being located pheripherally by respective annular mouldings 46, fixedly mounted in the respective spars. The moulding 46 for the spindle 40, is as shown, located in a central boss carried by the spar 36, while the moulding 46 for spindle 41 is carried by the boss 30 on the spar 26.

As explained in greater detail below, the plate 10 carries a cover arrangement 50 which, in a closed position, effectively prevents the passage of air through the aperture 11 in the plate 10. However, assuming the cover arrangement 50 to be opened, operation of the extractor is as follows.

Any wind current having at least a substantial component parallel with the median planes of the member 38 and members 12 and 34, and thus approximately parallel with the vertical plane of the pane 20, which, in turn, will normally be substantially parallel with the building wall in which the window is provided, will, in the region of the ventilator, tend to pass through the space between the portion 24 of the plate 12 and the plate 34, from one pheripheral region of the plate 34 to the diametrially opposite pheripheral region of plate 34. In so passing, the air current must pass around the lens 38 and, due to the form of the same and of the opposing surfaces of the plate 12 and the plate 34 such current will produce, in the region of the central aperture in the plate 12, by the Venturi effect, a significant reduction in air pressure, as a consequence of which air will be drawn from the interior of the building into the air stream passing between the plate 12 and the plate 34, transversely of the axis of the member 38. This effect will tend to be produced even when the mean air pressure on the outside of the wall having the window in which the extractor is fitted is momentarily somewhat greater than the air pressure in the space within the building immediately behind the extractor, so that the extent to which draughts tend to enter the building through the extractor is minimised.

Any wind current having at least a substantial component entering the central aperture 35 will be diverted into the air stream by the venturi ellipse 38 passing between plate 12 and plate 34 (see FIG. 3), with the consequent venturi effect previously described.

The area 25 of the front wall 24 of the plate 12 immediately around the central aperture 13, (see FIG. 6), is concavely dished on the side facing towards the member 38, this being a feature which has been found to contribute significantly to the efficiency of the extractor.

The inclination of the median planes of the plates 12 and 34 and the member 38 relative to the vertical has also been found to provide a significant improvement as compared with a completely vertical disposition of these planes.

Figure 4:
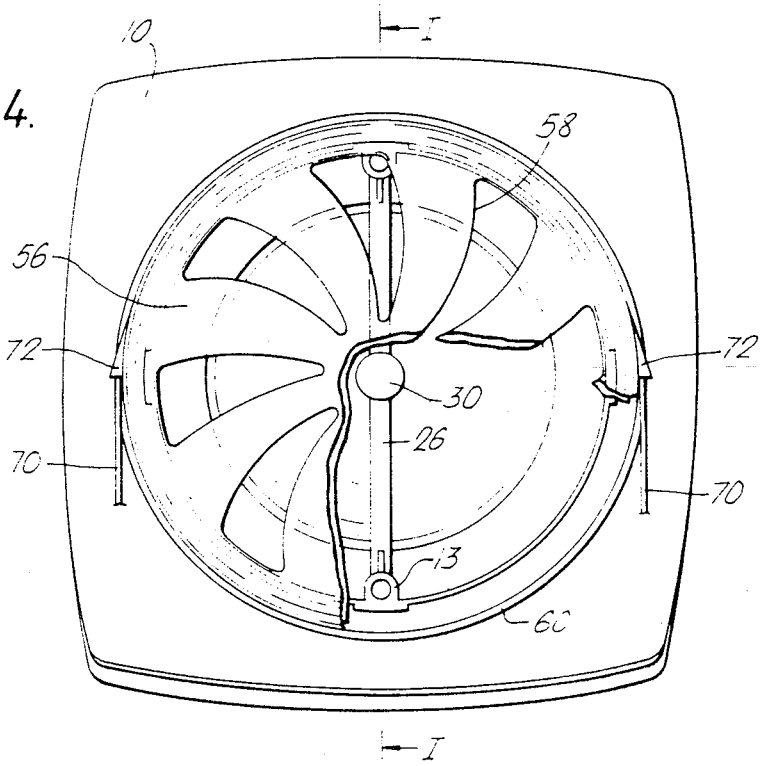
FIG. 4 is an elevation view, with part broken away, of the unit, from the inside of the window pane.

The cover arrangement 50 comprises, as shown in FIGS. 1 and 4, two superimposed, nested, circular dished plates 54 and 56, the plate 54 being detachably secured to the plate 10 and the plate 56 being mounted for limited angular movement relative to the plate 54 about their common central axis. The plates 54 and 56 each have a set of similar openings 58 therein (see FIG. 4). In one limiting angular position of the plate 56 relative to the plate 54 the openings 58 in plate 56 are in register with the openings 58 in the plate 54 to allow passage of air through the unit via aperture 11, whilst in the other limiting angular position of the plate 56 relative to the plate 54 the openings 58 in the plate 56 are fully out of register with the openings 58 in plate 54 and consequently, as the opposing surfaces of the parts of the plates 54 and 56 in which openings 58 are formed are everywhere in very close proximity with one another, the passage of air currents through the cover arrangement 50 is substantially prevented.

The plate 54 has a generally cylindrical peripheral wall 55 having a peripheral annular flange 57 extending outwardly from its free edge and which is located within an annular rib 60 projecting from the face of plate 10 remote from pane 20.

The plate 54 is secured to plate 10 by a bayonet fixing arrangement comprising lugs 62 projecting from plate 10 and engageable with complementary lugs 64 projecting inwardly from the rim of plate 54. The plate 54 is secured to the plate 10 by moving the plate 54 (and with it plate 56) axially into position within ribs 60, with the lugs 64 out of alignment with lugs 62 and then rotating the plate 54 to move the lugs 64 circumferentially behind the lugs 62. The axially opposing surfaces of the lugs 64 and 62 are inclined, in part-helical fashion, relative to the central axis of plates 54 and 56 and aperture 11 so that in such rotation of the plate 54 the latter is drawn firmly against plate 10 and is restrained against counter-rotation, in the opposite sense, by friction, but can be readily removed manually, by a force sufficient to overcome such friction.

In the arrangement shown the plate 56 has a central journal, in the form of a longitudinally split tubular stub 66 formed integrally therewith, and which is snap-fitted within a bearing in plate 54 formed by a tubular spigot 68 formed integrally with plate 54. However, if preferred, the peripheral wall of plate 56 may form a bearing journalling the peripheral wall of the plate 54. As best shown in FIG. 4, rotational movement of plate 56 relative to plate 54 is effected by means of cords 70 attached to formations 72 on the exterior of the peripheral wall of plate 56 at diametrally opposite positions.

The angular movement of plate 56 relative to plate 54 may be limited by, for example, providing on the interior of the peripheral wall of plate 56 an inwardly projecting abutment (not shown) confined circumferentially between two outwardly projecting abutments (not shown) on the peripheral wall of plate 54, or vice versa.

The member 38 may, be provided with turbo-fins, (not shown) and/or with integral turbo vanes encased between the shallow dome and the deep dome of the member 38, whereby a spinning motion is imparted in operation, to the body 38, and in this case, of course, the bearings 46 support the body 38 for rotation about its axis. These features, although not adding to the efficiency of the extractor, and, indeed, possibly detracting from its efficiency to an insignificant extent, may be incorporated to appeal to users or potential users of the extractor. It will be appreciated, therefore, that in the preferred form there is no need for the member 38 to rotate, and it may, indeed be supported rigidly and non-rotatably relative to the plates 12 and 34.

The ventilator described with reference to the drawings is capable of using wind currents in almost any direction to provide positive extraction of stale air, fumes, condensation etc from the building to which the unit is fitted, and minimises the entry of draughts, dust, etc into the building through the ventilator.

Furthermore the ventilator shown in the drawings can be manufactured at relatively low cost.

I claim:

1. A ventilator unit having an inner plate member, an outer plate member and an intermediate member, means mounting the outer member spaced from the inner plate member along a central axis of the ventilator unit, and means mounting the intermediate member at a location between the inner and outer members, the inner plate member having a central aperture therethrough concentric with said central axis of the ventilator, an annular surface around said central aperture and concentric therewith, which annular surface faces towards said outer plate member and is concavely curved, said outer plate member being in the form of a dished plate having a concave surface facing towards said inner plate member and a convex surface facing away from said inner plate member, said intermediate member being lens-shaped having an outer convex surface facing said concave surface of the outer plate member and an inner convex surface facing the concave surface of the inner plate member, the lens-shaped member having its axis of rotational symmetry coinciding with said central axis of the ventilator unit, said inner plate member having engagement portions with surfaces for engagement with a wall or the like surface adjacently surrounding an opening therethrough, said surfaces being spaced from said concave annular surface of the inner plate member in the opposite direction from that in which the intermediate member is spaced from said inner plate member, said engagement surfaces facing away from the outer plate member and intermediate plate member, said engagement surfaces lying in a common plane.

2. A ventilator unit according to claim 1, wherein the intermediate lens-shaped member has spindles extending therefrom along said central axis in opposite directions, and said means mounting said intermediate member supports said intermediate member by means of said spindles, the last-mentioned mounting means including a spar spanning said aperture in the inner plate member and a mounting element on said spar engaging the free end of one said spindle, and an element on the outer plate member engaging the free end of the other said spindle, said means mounting the outer member spaced from the inner member along said axis including a plurality of pillars each extending from the outer plate member to the inner plate member, each said pillar being spaced radially outwardly from said intermediate member, relative to said central axis, and being without connection to said intermediate member.

3. A ventilator installation including a sheet-like supporting member having an aperture therein, a ventilator unit, and means securing said ventilator unit to said sheet-like supporting member so that the ventilator unit covers said aperture therein, said ventilator unit having an inner plate member, an outer plate member, means mounting the outer member spaced from the inner plate member along a central axis of the ventilator unit, and an intermediate member located between the inner and outer members, the inner plate member having a central aperture therethrough concentric with said central axis of the ventilator unit, an annular surface around said central aperture and concentric therewith, which annular surface faces towards the outer plate member and is concavely curved, said outer plate member being in the form of a dished plate having a concave surface facing towards said inner plate member and a convex surface facing away from said inner plate member, said intermediate member being lens-shaped having an outer convex surface facing said concave surface of the outer plate member and an inner convex surface facing the concave surface of the inner plate member, the lens-shaped member having its axis of rotational symmetry coinciding with said central axis of the ventilator unit, the intermediate lens-shaped member having spindles extending therefrom along said central axis in opposite directions, and means mounting said intermediate member by means of said spindles, the last-mentioned means including a spar spanning said aperture in the inner plate member and a mounting element on said spar engaging the free end of one said spindle, and an element on the outer plate member engaging the free end of the other said spindle, said means mounting the outer member spaced from the inner member along said axis including a plurality of pillars each extending from the outer plate member to the inner plate member, each said pillar being spaced radially outwardly from said intermediate member, relative to said axis, and being without connection to said intermediate member, said inner plate member having engagement portions with surfaces for engagement with a wall or the like surface, said surfaces being spaced from said concave annular surface of the inner plate member in the opposite direction from that in which the intermediate member is spaced from said inner plate member, said engagement surfaces facing away from the outer plate member and the intermediate plate member, said engagement surfaces lying in a common plane, said ventilator unit engaging said sheet-like member via said engagement surfaces of the inner plate member and said aperture in the inner plate member being in communication with said aperture in the sheet-like member.

4. A passive ventilator unit for mounting about an opening defined through a vertical exterior wall of a building for promoting exhaust of interior air gases to the external ambient and for impeding intrusion of external ambient air currents into the interior of the building through said opening, said ventilator unit comprising:

an interior subassembly including a flanged mounting plate for engaging an inner surface of said wall adjacent the periphery of said opening therethrough, said mounting plate defining a central aperture therethrough and including openable closure means operable from the interior of said building to open and close said central aperture, an exterior subassembly including an inner plate for engaging an outer surface of said wall adjacent the periphery of said opening therethrough opposite to said flange mounting plate, an inner plate locking means for locking said inner plate to said flanged mounting plate through said opening whereby said ventilator unit may be secured to said wall, said inner plate further including a central aperture therethrough and sealing means for achieving a weathertight seal about said engaged outer surface of said wall;

said exterior subassembly further including a thin outer plate member spaced away from and secured to said inner plate by posts so as to define an air passage between said inner plate and said outer plate member substantially parallel with said vertical wall, said outer plate member defining a concave surface facing said inner plate and defining a convex surface facing away from said inner plate;

said exterior subassembly further including an intermediate double-convex lens-shaped member placed centrally in said air passage and having an axis of rotational symmetry in substantial alignment with the center of said opening defined by said inner plate, said lens-shaped member being secured between a diametral strut of said inner plate and a support formed on outer plate member.

5. The passive ventilator defined by claim 4 wherein said intermediate lens-shaped member is journalled to said exterior subassembly for rotation about its said axis of rotational symmetry.

6. The passive ventilator defined by claim 4 wherein said inner plate, said outer plate member and said intermediate double-convex lens-shaped member are aligned to lie in parallel planes which define a predetermined acute angle diverging upwardly away from said vertical wall.

7. The passive ventilator defined by claim 4 wherein said inner plate includes a concaved surface adjacent said central aperture therethrough facing said intermediate double-convex lens-shaped member.

8. The passive ventilator defined by claim 4 wherein said vertical exterior wall comprises a window pane.

* * * * *